United States Patent [19]

Tibbals et al.

[11] Patent Number: 4,530,758

[45] Date of Patent: Jul. 23, 1985

[54] ORE FLOTATION METHOD

[75] Inventors: Rory L. Tibbals; Kim N. Unger, both of Tucson, Ariz.

[73] Assignee: Thiotech, Inc., Tucson, Ariz.

[21] Appl. No.: 578,990

[22] Filed: Feb. 13, 1984

Related U.S. Application Data

[63] Continuation of Ser. No. 379,164, May 17, 1982, abandoned.

[51] Int. Cl.[3] ..... B03D 1/14

[52] U.S. Cl. ..... 209/166; 252/61

[58] Field of Search ..... 209/166, 167

[56] References Cited

U.S. PATENT DOCUMENTS

| | | | |
|---|---|---|---|
| 1,868,192 | 7/1932 | Buchanan | 209/166 |
| 1,997,280 | 4/1935 | Christmann et al. | 209/166 |
| 2,206,284 | 7/1940 | Jayne | 252/61 |
| 2,620,068 | 12/1952 | Allen et al. | 209/167 |
| 3,570,772 | 3/1971 | Booth et al. | 209/167 |
| 3,925,218 | 12/1975 | Zipperian et al. | 209/166 |

FOREIGN PATENT DOCUMENTS

| | | | |
|---|---|---|---|
| 159133 | 9/1954 | Australia | 209/167 |
| 225227 | 10/1959 | Australia | 209/167 |
| 2389414 | 12/1978 | France | 209/166 |
| 455224 | 10/1936 | United Kingdom | 209/166 |

*Primary Examiner*—Bernard Nozick

*Attorney, Agent, or Firm*—Weiss & Holloway

[57] ABSTRACT

The method of recovering copper from a copper-bearing ore which comprises froth flotation of the ore in alkaline circuit and in the presence of a phosphorodithio compound of the formula

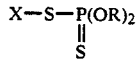

wherein X is hydrogen, alkali metal, or the ammonium radical and R is alkyl-substituted phenyl of from 6 to 14 carbon atoms having from 1 to 3 alkyl substituents and from 1 to 6 carbon atoms in each alkyl substituent. Sodium O,O-bis(isopropylphenyl) phosphorodithioate and O,O-bis(isopropylphenyl) phosphorodithoic acid are illustrative. The method is particularly useful with sulfide minerals, especially with copper sulfides and molybdenum sulfides.

7 Claims, No Drawings

ORE FLOTATION METHOD

This application is a continuation of application Ser. No. 379,164, filed 5/17/82, now abandoned.

BACKGROUND OF THE INVENTION

1. Field of the Invention

This invention relates generally to ore dressing methods and to concentration of metal values in ores by flotation. More particularly, the invention provides a new and valuable method of recovering copper and molybdenum values from ores, which comprises froth flotation of a slurry of the ore conducted in alkaline circuit and in the presence of a collector comprising certain alkylphenyl phosphorodithioic acids or salts thereof.

2. Description of the Prior Art

Flotation is a widely used method of concentrating ores, and is believed to be the most commonly employed ore dressing process. It is based on the fact that when air bubbles are introduced into a ground ore pulp, particles of some minerals will become attached to the bubbles, whereas other minerals will not become so attached and remain in the pulp. Certain chemicals facilitate flotation by conferring adherency and/or water repellency to surfaces of minerals to be floated, and such chemicals have been generally called "promoters" or "collectors". Herein, they will be referred to as collectors. It is customary in the art to employ other additives or reagents in flotation; for example, there may also be used materials which serve as frothers, activators, depressants or modifying agents. The presence or absence of such reagents and their nature will vary with ores and reaction conditions, and selection of such other additives for serving differing functions can be readily arrived at by easy experimentation.

The flotation art dates at least as far back as the early 1900's, and numerous materials have been found to serve as collectors, for example, the xanthates, the thiocarbanilids and the thionocarbamates. Industrially, collectors for use in flotation are of great importance because even a very small improvement in the efficacy of the collector can have immense commercial effect. With the growing current practice of tailings retreatment, the cost efficiency of the collector becomes increasingly significant. Also of concern are possible toxicity and environmental implications as well as storage and handling.

SUMMARY OF THE INVENTION

Accordingly, an object of the invention is the provision of a flotation process wherein there is employed a collector which achieves improved recovery of metal selected from the class consisting of copper and molybdenum at nominal cost and without substantial detriment to health and environment.

Another object is the provision of a flotation method which will be useful with a great variety of sulfidic and non-sulfidic ores of said metal. Still another object is the provision of a method which will be effective even under conditions where slime interference may present a problem. A most important object is the provision of an efficient flotation process of recovering said metal values from sulfide ores, and especially copper sulfides and molybdenum sulfides.

These and other objects hereinafter disclosed are met by the invention wherein flotation of the ore is conducted in the presence of a collector comprising a phosphorodithio compound of the formula:

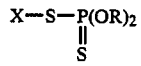

wherein X is selected from the class consisting of hydrogen, alkali metal and the ammonium radical, and R is an alkyl-substituted phenyl radical having a total of from 8 to 14 carbon atoms, from 1 to 3 alkyl substituents, and from 1 to 6 carbon atoms in each alkyl substituent.

Compounds of the above formula include the O,O-bis(alkylphenyl)phosphorodithioic acids:

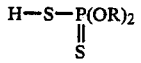

wherein there are present from 1 to 3 alkyl radicals attached to the phenyl ring. Some examples thereof are O,O-bis(2-, 3-, or 4-ethylphenyl)phosphorodithioic acid O,O-bis(2, 3- or 2,4-dimethylphenyl)phosphorodithioic acid O,O-bis(2,3,4- or 2,4,6-trimethylphenyl)phosphorodithioic acid O,O-bis(4-isobutyl- or 4-hexylphenyl)phosphorodithioic acid O,O-bis(2,4-di-n-butylphenyl)phosphorodithioic acid O-4-isopropylphenyl 0-3-pentylphenyl phosphorodithioic acid Presently useful alkali metal salts of the phosphorodithioic acids include the sodium potassium, lithium or rubidium salts. They may be depicted by the general formula:

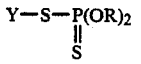

where Y is alkali metal. Examples of such salts are:

sodium O,O-bis(4-sec-butylphenyl)phosphorodithioate lithium O,O-bis(3,4,5-trimethylphenyl)phosphorodithioate potassium O,O-bis(2,5-diethylphenyl)phosphorodithioate rubidium O-3-propylphenyl O-4 ethylphenyl phosphorodithioate The ammonium salts

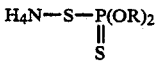

are similarly useful. Examples thereof are the ammonium O,O-bis(2,4, or 3,4-ethylphenyl) or the O,O-bis(2,3-, or 2,5-dibutylphenyl)phosphorodithioates.

Of particular commercial interest are mixtures of isomeric compounds in which the same alkyl radical is present in different positions on the phenyl residue; for example, a mixture of sodium O,O-bis(4-isopropylphenyl)phosphorodithioate and sodium O,O-bis(3-isopropylphenyl)phosphorodithioate. Such mixtures are readily obtained by using the crude isopropylphenol of commerce in preparing the phosphorodithioate. Such mixtures function very well in the present process and are much less expensive than the individual compounds.

Mixtures of isomeric free acids or of free acids and alkali metal or ammonium salts are also useful and often convenient.

Although the invention is very valuable for the concentration of copper from sulfidic ores, the presently provided flotation method is generally useful with ores of copper and/or molybdenum, is effective over a wide pH range, and can provide improved selectivity at substantial time savings in alkaline flotation circuits.

The invention is further illustrated by, but not limited to, the following examples:

EXAMPLE 1

This example describes testing of the following materials for collector efficacy.

I. Sodium O,O-bis(isopropylphenyl)phosphorodithioate

II. Potassium amyl xanthate

Porphyry ore was crushed to minus 10 mesh and 600 g of the crushed ore was ground in the laboratory ball mill together with 500 ml of water, 0.25 g of lime, 10 mg of a fuel oil grade liquid hydrocarbon, and 10 mg of either (I) or (II). The 10 mg corresponded to 0.0333 lb of collector per ton of ore. The resulting slurry was transferred to a laboratory flotation machine, and mixed with 100 mg of methylisobutylcarbinol. Air was then added with agitation during a flotation time of 4 minutes. Assay of the resulting concentrate and tailing gave the following results:

| Collector | Copper, % recovery |
|---|---|
| I | 86.77 |
| II | 74.77 |

Although acceptable grades of metal were obtained with either (I) or (II), the very good recovery brought about by using the present phosphorodithioate instead of the commonly employed xanthate is surprising.

EXAMPLE 2

Use of sodium O,O-bis(isopropylphenyl)phosphorodithioate in even small quantities results in high percent recovery of both copper and molybdenum. A very good grade of copper is thereby obtained. This is illustrated by the following: Using 700 g of porphyry ore crushed to minus 10 mesh, and ground to liberation in a laboratory ball mill with 0.8 g of lime, 20 mg of commercial alcohol frother and 2.5 mg of said phosphorodithioate (corresponding to 0.0071 lb of collector per ton of ore), and employing a flotation time of 4 minutes, there was obtained an 87.7% recovery of copper having a grade value of 9.71. With the same procedure, an 89.5 percent recovery of molybdenum was achieved.

EXAMPLE 3

This example is like Example 1, except that the collector is a free acid rather than a phosphorodithioate. The following results were obtained with the concentrations of O,O-bis(4-isopropylphenyl)phosphorodithioic acid shown below:

| concentration, mg | copper, % recovery | molybdenum, % recovery |
|---|---|---|
| 5 | 84.2 | 81.2 |

-continued

| concentration, mg | copper, % recovery | molybdenum, % recovery |
|---|---|---|
| 10 | 86.3 | 83.9 |

EXAMPLE 4

The following compounds were evaluated as collectors with Utah copper ore:

A. O,O-bis(3-ethylphenyl)phosphorodithioic acid
B. O,O-bis(4-sec-butylphenyl)phosphorodithioic acid
C. O,O-bis(2-sec-amylphenyl)phosphorodithioic acid
D. O,O-bis(3,5-dimethylphenyl)phosphorodithioic acid
E. O,O bis(3,6-dimethylphenyl)phosphorodithioic acid
F. O,O-bis(3,4-dimethylphenyl)phosphorodithioic acid A mixture consisting of 500 g of the ore (crushed to minus 10 mesh), and ground to liberation in a laboratory ball mill with 1.8 g of lime, 0.015 lb/ton of calcium cyanide, 0.2 lb/ton of commercial alcohol frother, and 0.4 lb/ton of one of the above phosphorodithioic acids was agitated with air in a laboratory flotation machine during a flotation time of 5 minutes. The following results were thus obtained:

| Test compound | Product | % Weight | Assay, copper |
|---|---|---|---|
| A | concentrate | 4.56 | 17.98 |
| | tailings | 95.44 | .170 |
| B | concentrate | 4.35 | 20.32 |
| | tailings | 95.65 | .119 |
| C | concentrate | 4.21 | 18.69 |
| | tailings | 95.79 | .217 |
| D | concentrate | 4.73 | 19.71 |
| | tailings | 95.27 | .094 |
| E | concentrate | 5.30 | 17.47 |
| | tailings | 94.70 | .069 |
| F | concentrate | 5.47 | 17.17 |
| | tailings | 94.53 | .069 |

The presently defined phosphorodithioic acids and salts are generally useful in ore dressing, but they are particularly valuable for working with sulfides in that they demonstrate high selectivity against pyrite and pyrrhotite. They possess exceptional utility in the flotation of sulfide copper and copper activated zinc sulfide from alkaline pulps. In many cases where slime or talc interference is a problem, the herein described compounds will produce higher concentrate grades and recoveries.

The herein described flotation procedures are given by way of illustration only, since any ore dressing flotation technique for copper and molybdenum may be used as long as the presently described phosphorodithio compounds are employed as collectors.

What is claimed is:

1. The method of recovering copper from a copper-bearing ore which comprises froth flotation of the ore in alkaline circuit and in alkaline circuit in the presence of a phosphorodithio compound of the formula:

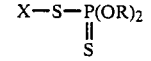

wherein X is selected from the class consisting of hydrogen, alkali metal and ammonium and R is an alkyl-substituted phenyl radical having a total of from 8 to 14 carbon atoms, from 1 to 3 alkyl substituents, and from 2 to 6 carbon atoms in each alkyl substituent.

2. The ore dressing method defined in claim 1, further limited in that X is hydrogen.

3. The ore dressing method defined in claim 1, further limited in that X is alkali metal.

4. The ore dressing method defined in claim 1, further limited in that X is sodium.

5. The ore dressing method defined in claim 1, further limited in that X is the ammonium radical.

6. A method of recovering copper from a copper-bearing ore which comprises froth flotation of the ore in alkaline circuit and in the presence of a phosphorodithio compound of the formula:

$$X-S-\underset{\underset{S}{\|}}{P}(OR)_2$$

wherein X is selected from the class consisting of hydrogen, alkali metal and ammonium, R is an alkyl-substituted phenyl radical having a total of from 8 to 14 carbon atoms, from 1 to 3 alkyl substituents, and from 1 to 6 carbon atoms in each alkyl substituent, and the phosphorodithio compound is sodium, O,O-bis(isopropylphenyl)phosphorodithiate.

7. A method of recovering copper from a copper-bearing ore which comprises froth flotation of the ore in alkaline circuit and in the presence of a phosphorodithio compound of the formula:

$$X-S-\underset{\underset{S}{\|}}{P}(OR)_2$$

wherein X is selected from the class consisting of hydrogen, alkali metal and ammonium, R is an alkyl-substituted phenyl radical having a total of from 8 to 14 carbon atoms, from 1 to 3 alkyl substituents, and from 1 to 6 carbon atoms in each alkyl substituent, and the phosphorodithio compound is O,O-bis(isopropylphenyl)phosphorodithioic acid.

* * * * *